US005222377A

United States Patent [19]

Squires

[11] Patent Number: 5,222,377

[45] Date of Patent: Jun. 29, 1993

[54] ADAPTER PLATE FOR REFRIGERATION SYSTEM SERVICING

[75] Inventor: David C. Squires, Port Huron, Mich.

[73] Assignee: Squires Enterprises, Inc., Port Huron, Mich.

[21] Appl. No.: 923,464

[22] Filed: Aug. 3, 1992

[51] Int. Cl.[5] ..... F25B 45/00

[52] U.S. Cl. ..... 62/292; 251/148; 285/156; 285/412

[58] Field of Search ..... 62/77, 149, 292; 417/435, 440, 442; 137/878; 251/148; 285/150, 156, 405, 412

[56] References Cited

U.S. PATENT DOCUMENTS

| | | | |
|---|---|---|---|
| Re. 27,233 | 11/1971 | Johnston | 137/878 X |
| 1,212,886 | 1/1917 | Benson | 251/148 X |
| 1,767,383 | 6/1930 | Linendoll | 137/878 X |
| 2,649,105 | 8/1953 | Stout et al. | 251/148 X |
| 3,645,496 | 2/1972 | Rawlins | 62/292 X |
| 4,338,793 | 7/1982 | O'Hern, Jr. | 62/292 |
| 4,384,736 | 5/1983 | Hartung | 285/156 X |
| 4,616,677 | 10/1986 | Krechel et al. | 137/878 X |
| 4,618,314 | 10/1986 | Hailey | 285/156 X |

*Primary Examiner*—William E. Tapolcai
*Attorney, Agent, or Firm*—Harness, Dickey & Pierce

[57] ABSTRACT

An adapter plate for mounting to the outlet side of a refrigeration system compressor including one or two fittings for retrieving refrigerant from the cooling system prior to servicing so as to avoid discharge of the refrigerant gas into the atmosphere. The adapter plate provides a larger fitting than typically provided in refrigerant systems, thereby enabling the retrieval process to be accomplished in a shorter amount of time.

9 Claims, 1 Drawing Sheet

ADAPTER PLATE FOR REFRIGERATION SYSTEM SERVICING

BACKGROUND AND SUMMARY OF THE INVENTION

The present invention relates to an adapter plate for assisting in the servicing of a refrigeration system including at least one connecting port for use in retrieving refrigerant from the refrigeration system in preparation for servicing.

In recent years considerable attention has been drawn to the need for retrieving refrigerant gases from a refrigeration system prior to servicing such a system to avoid the discharge of the refrigerant gases into the atmosphere. Discharge of several types of refrigerants into the atmosphere is believed to have an adverse effect on the atmospheric ozone layer. Many of the refrigerant retrieval devices retrieve refrigerant at the high pressure, outlet side of the refrigeration system compressor. Many refrigeration systems include a fitting at the compressor outlet that can be used for refrigerant retrieval. However, these fittings are primarily for the purpose of providing access for making pressure readings and are relatively small, on the order of ¼ inch diameter. The flow rate of refrigerant available through such a small fitting is low whereby the retrieval process is slow and the time necessary for servicing the refrigeration system is lengthened considerably.

While regulations are in place in many jurisdictions requiring that refrigerant be retrieved rather than being discharged into the atmosphere, due to the added time necessary to retrieve the refrigerant, compliance with these regulations is not as high as desired. This is in part due to the low cost of new refrigerant compared to the time and expense necessary in retrieving the refrigerant from the cooling system. As a result, it is necessary to provide refrigerant retrieval methods capable of rapidly retrieving the refrigerant.

Accordingly, it is an object of the present invention to provide an adapter plate at the outlet side of the compressor which is sized to fit the compressor outlet and which includes a larger connection fitting for use in retrieving refrigerant from the cooling system. The adapter plate includes a through passage for flow of refrigerant from the compressor outlet to the refrigeration system with one or two connector fittings communicating with the through passage for use in retrieving compressed refrigerant gas at a higher flow rate than possible with the original smaller fitting.

Further objects, features and advantages of the invention will become apparent from a consideration of the following description and the appended claims when taken in connection with the accompanying drawings.

DETAILED DESCRIPTION OF THE INVENTION

Figure 1:
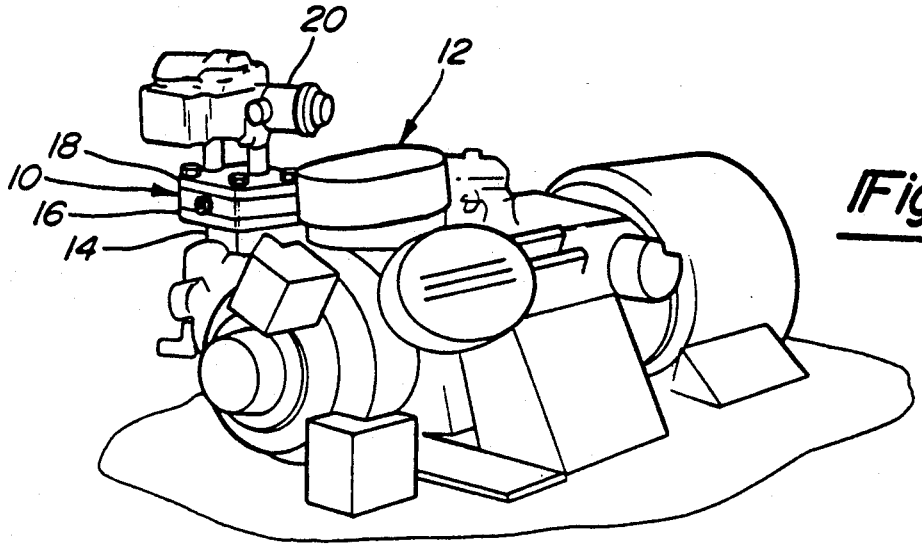
FIG. 1 is a perspective view of a typical refrigeration system compressor.

The adapter plate of the present invention is designated generally at 10 and is shown in FIG. 1 mounted to a compressor 12 of a refrigeration system. The compressor 12 includes an outlet passage 14 which terminates in a mounting flange 16. The refrigeration system includes a connecting flange 18 which would be coupled to the mounting flange 16 of the compressor outlet without the adapter plate 10 of the present invention. A service valve fitting 20 is typically provided for access to the refrigerant, primarily to read the system pressure. Such a service valve fitting typically has a ¼ inch outlet. The refrigerant flow rate available through the ¼ inch outlet for refrigerant retrieval is low, requiring an extensive period of time for retrieving the refrigerant before the cooling system can be repaired.

Figure 2:
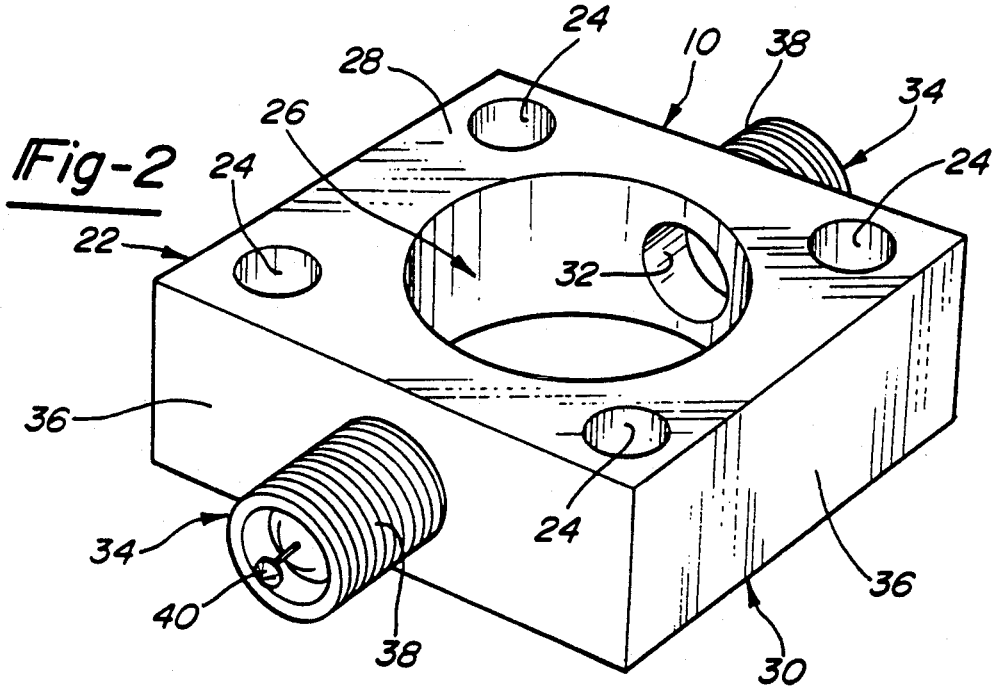
FIG. 2 is a perspective view of one embodiment of the adapter plate of the present invention.

The adapter plate 10 of the present invention, shown in greater detail in FIG. 2 includes a plate 22 configured to fit between the mounting flange 16 of the compressor and the connecting flange 18 of the cooling system. Bolt holes 24 arranged in the appropriate pattern extend through the plate 22 for connecting the plate to the mounting and connecting flanges 16 and 18.

The plate 22 includes a through passage 26 for coolant flow which is generally normal to the two face surfaces 28 and 30 of the plate 22. Connecting passages 32 are provided through the plate 22 generally parallel to the face surfaces 28 and 30 and terminate in fittings 34 projecting from the exterior side edges 36 of the plate 22. The fittings are provided with external threads 38 and an internal valve 40, such as a schrader valve. Preferably, the fittings 34 are of 7/16 or ½ inch in diameter so as to provide a greater flow rate for the refrigerant from the cooling system. The plate 22 is generally between ⅝ and ¾ of an inch in thickness to provide the necessary diameter to the connecting passages and fittings for refrigerant retrieval. However, it is to be understood that the particular dimensions of the plate and fittings are not to be viewed as limitations. Plates and fittings of other sizes can also be used.

Figure 3:
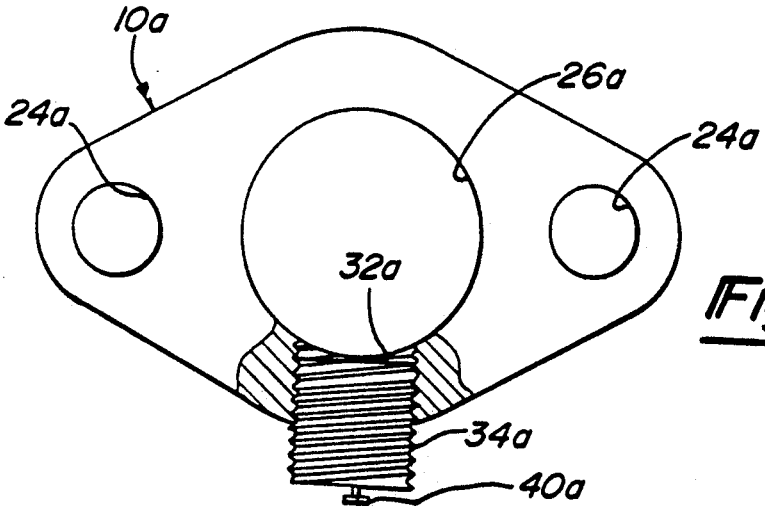
FIG. 3 is a perspective view of a second embodiment of the adapter plate of the present invention.

FIG. 3 illustrates an alternative embodiment 10*a* of the adapter plate of the present invention which differs from the adapter plate 10 primarily in the shape of the plate 22 and the number of bolt holes provided. The adapter plate 10*a* is formed with only two bolt holes 24 and a single connecting passage 32*a* and fitting 34*a*.

The adapter plate 10 can be installed in a refrigeration system during the first servicing of the system. During subsequent servicing, the larger diameter fitting of the adapter plate will be available for use in retrieving refrigerant. By reducing the time necessary to retrieve the refrigerant, the retrieval process becomes less costly, thereby reducing a disincentive to retrieving the refrigerant.

It is to be understood that the invention is not limited to the exact construction illustrated and described above, but that various changes and modifications may be made without departing from the spirit and scope of the invention as defined in the following claims.

I claim:

1. An adapter for a refrigeration system including a compressor, an outlet for compressed refrigerant from said compressor, a coupling for joining said outlet to said refrigeration system including first and second flanges joined together with a refrigerant flow passage extending through said first and second flanges, said adapter comprising:

a plate having a pair of generally parallel opposite face surfaces and a side surface between said opposite face surfaces forming a perimeter of said plate, a bore extending through said plate between said opposite face surfaces;

means for mounting said plate between said first and second flanges of said coupling with said bore aligned with said refrigerant flow passage forming a through passage for said refrigerant; and connector means in communication with said bore for removing refrigerant from said refrigeration system prior to servicing of said refrigeration system.

2. The adapter of claim 1 wherein said connector means includes a fitting extending from said plate and valve means within said fitting normally closing said connector means.

3. The adapter of claim 2 wherein said fitting extends from said side surface of said plate.

4. The adapter of claim 1 wherein said means for mounting said plate includes through holes in said plate generally normal to said face surfaces and aligned with threaded fasteners for joining said plate and said first and second flanges.

5. The adapter of claim 1 wherein said connector means includes a pair of said fittings.

6. The adapter of claim 2 wherein said fitting is at least $\frac{1}{2}$ inch in diameter.

7. The adapter of claim 2 wherein said fitting is between $\frac{1}{2}$ and $\frac{1}{4}$ of an inch in diameter.

8. An adapter for a refrigeration system including a compressor, an outlet for compressed refrigerant from said compressor, a coupling for joining said outlet to said refrigeration system including first and second flanges each having bolt holes therethrough for threaded fasteners to join said flanges with a refrigerant flow passage extending through said first and second flanges, said adapter comprising:

a plate having a pair of generally parallel opposite face surfaces and a side surface between said opposite face surfaces forming a perimeter of said plate;

a bore extending through said plate between said opposite face surfaces and aligned with said refrigerant flow passage;

through holes in said plate generally normal to said face surfaces and aligned with said threaded fasteners for mounting said plate between said first and second flanges of said coupling with said bore aligned with said refrigerant flow passage forming a through passage for said refrigerant;

a connecting passage between said bore and plate side surface for removing refrigerant from said refrigeration system prior to servicing of said refrigeration system;

said connecting passage terminating in a fitting extending from said side surface of said plate; and a normally closed valve within said fitting to close said connecting passage.

9. The adapter of claim 8 wherein said valve is a schrader valve.

* * * * *

UNITED STATES PATENT AND TRADEMARK OFFICE

CERTIFICATE OF CORRECTION

PATENT NO. :5,222,377
DATED :June 29, 1993
INVENTOR(S) :David C. Squires

It is certified that error appears in the above-indentified patent and that said Letters Patent is hereby corrected as shown below:

Column 3, line 26, Claim 7, after "1/2 and delete "1/4 and insert --3/4--.

Signed and Sealed this

Fifteenth Day of March, 1994

*Attest:*

*Attesting Officer*

Bruce Lehman

BRUCE LEHMAN

*Commissioner of Patents and Trademarks*